US011703202B2

(12) United States Patent
Bushre et al.

(10) Patent No.: US 11,703,202 B2
(45) Date of Patent: Jul. 18, 2023

(54) IMAGE PROJECTION LIGHTING ASSEMBLY

(71) Applicant: ams OSRAM Automotive Lighting Systems USA Inc., Troy, MI (US)

(72) Inventors: Adam L. Bushre, Saranac, MI (US); Thomas Tessnow, Weare, NH (US)

(73) Assignee: AMS OSRAM AUTOMOTIVE LIGHTING SYSTEMS USA INC., Troy, MI (US)

( * ) Notice: Subject to any disclaimer, the term of this patent is extended or adjusted under 35 U.S.C. 154(b) by 144 days.

(21) Appl. No.: 17/398,362

(22) Filed: Aug. 10, 2021

(65) Prior Publication Data

US 2023/0047462 A1 Feb. 16, 2023

(51) Int. Cl.

| | |
|---|---|
| ***F21S 43/20*** | (2018.01) |
| ***F21V 23/00*** | (2015.01) |
| ***F21V 11/14*** | (2006.01) |
| ***F21V 5/04*** | (2006.01) |
| ***F21W 103/60*** | (2018.01) |

(52) U.S. Cl.

CPC ..... *F21S 43/26* (2018.01); *F21V 5/045* (2013.01); *F21V 11/14* (2013.01); *F21V 23/003* (2013.01); *F21W 2103/60* (2018.01)

(58) Field of Classification Search

CPC ..... F21S 43/26; F21V 5/045; F21V 11/14; F21V 23/003

See application file for complete search history.

(56) References Cited

U.S. PATENT DOCUMENTS

| | | | | |
|---|---|---|---|---|
| 7,762,697 | B2 * | 7/2010 | Yagi | G02B 19/0028 362/336 |
| 8,905,609 | B2 * | 12/2014 | Tessnow | F21S 41/148 362/543 |
| 9,557,027 | B2 * | 1/2017 | Kai | G02B 6/002 |
| 10,295,137 | B2 | 5/2019 | Stefanov et al. | |

(Continued)

FOREIGN PATENT DOCUMENTS

| | | | |
|---|---|---|---|
| DE | 102012104845 | A1 | 12/2013 |
| DE | 102019112343 | A1 | 11/2020 |

(Continued)

OTHER PUBLICATIONS

Hocheng, et al., Analysis and fabrication of minifeature lamp lens by excimer laser micromachining, Applied Optics, vol. 46, No. 29, Oct. 10, 2007, pp. 7184-7189.

*Primary Examiner* — Bryon T Gyllstrom
(74) *Attorney, Agent, or Firm* — Brooks Kushman P.C.

(57) ABSTRACT

A lighting assembly is provided with a housing defining a cavity that is aligned along a longitudinal axis. A light source is supported by the housing and aligned with the longitudinal axis. A lens is supported by the housing to collimate light from the light source. An image plate with a plurality of apertures formed through passes a portion of the collimated light as light segments. An exit lens includes a first series of optics arranged on a first plane spaced apart from the image plate at a first focal distance to focus the light segments at a first distance from the housing, and a second series of optics arranged on a second plane spaced apart from the image plate at a second focal distance to focus the light segments at a second distance from the housing. The second focal distance is greater than the first focal distance.

20 Claims, 8 Drawing Sheets

(56) References Cited

U.S. PATENT DOCUMENTS

| | | | | |
|---|---|---|---|---|
| 10,612,741 | B2 | 4/2020 | Moser et al. | |
| 10,760,762 | B2 | 9/2020 | Nykerk et al. | |
| 2003/0053310 | A1* | 3/2003 | Sommers | F21V 19/001 362/249.05 |
| 2005/0141213 | A1* | 6/2005 | Gasquet | G02B 6/0006 362/35 |
| 2005/0152153 | A1* | 7/2005 | Amano | F21S 43/26 362/520 |
| 2008/0310159 | A1* | 12/2008 | Chinniah | F21S 41/322 362/244 |
| 2020/0072433 | A1 | 3/2020 | Scoville | |

FOREIGN PATENT DOCUMENTS

| | | | |
|---|---|---|---|
| WO | 2018229131 | A1 | 12/2018 |
| WO | 2020074218 | A1 | 4/2020 |
| WO | 2020074508 | A1 | 4/2020 |

* cited by examiner

IMAGE PROJECTION LIGHTING ASSEMBLY

TECHNICAL FIELD

One or more embodiments relate to a vehicle lighting assembly for projecting light in an illumination pattern to form an image.

BACKGROUND

Vehicle light projection systems may be used for multiple applications, such as illumination, conveying information, and entertainment. Vehicle packaging constraints may limit the locations available to mount such systems, resulting in a system with an optical axis that is non-orthogonal relative to the surface it is projecting light onto. When a conventional light projection system is mounted at such an angle, the intensity of the projected light declines exponentially with increasing distance from the light source. Therefore, a projected image will appear brighter closer to the light source. Further, conventional projection systems typically project one image onto the ground, if part of the projection lens is covered, a shadow may appear on the projected image, thereby distorting the image. Conventional light projection systems may use an inlet array of small ("micro") lenses to collimate light and an exit array of small micro lenses to generate an image. Such an arrangement requires precise alignment between corresponding lenses to avoid "cross-talk," resulting in expensive manufacturing processes.

SUMMARY

In one embodiment, a lighting assembly is provided with a housing defining a cavity that is aligned along a longitudinal axis. At least one light source is supported by the housing and aligned with the longitudinal axis. At least one lens is supported by the housing to collimate light from the light source. An image plate with a plurality of apertures formed through passes a portion of the collimated light as light segments. An exit lens includes a first series of optics arranged on a first plane spaced apart from the image plate at a first focal distance to focus the light segments at a first distance from the housing, and a second series of optics arranged on a second plane spaced apart from the image plate at a second focal distance to focus the light segments at a second distance from the housing. The second focal distance is greater than the first focal distance.

In another embodiment, a lighting assembly is provided with a housing defining a cavity that is aligned along a longitudinal axis. At least one light source is supported by the housing and aligned with the longitudinal axis. At least one lens is supported by the housing to collimate light from the light source. An image plate with a plurality of apertures formed through passes a portion of the collimated light as light segments. A first series of optics is spaced apart from the image plate at a first focal distance to focus the light segments at a first distance from the housing. A second series of optics is spaced apart from the image plate at a second focal distance to focus the light segments at a second distance from the housing, wherein the second distance is greater than the first distance.

In yet another embodiment, a method is provided for illumination. A first light source in a light assembly is activated to generate light through an axially aligned first collimator and corresponding axially aligned first apertures of an image plate, and then through a first series of optics arranged at a first focal distance from the image plate to project a first image segment at a first distance. A second light source in the light assembly is activated to generate light through an axially aligned second collimator and corresponding axially aligned second apertures of the image plate, and then through a second series of optics arranged at a second focal distance from the image plate to project a second image segment at a second distance, wherein the first image segment and the second image segment collectively provide an image.

As such, the lighting assembly and method utilize an exit lens with multiple focal distances to provide an image with uniform intensity over an extended distance from the light source.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
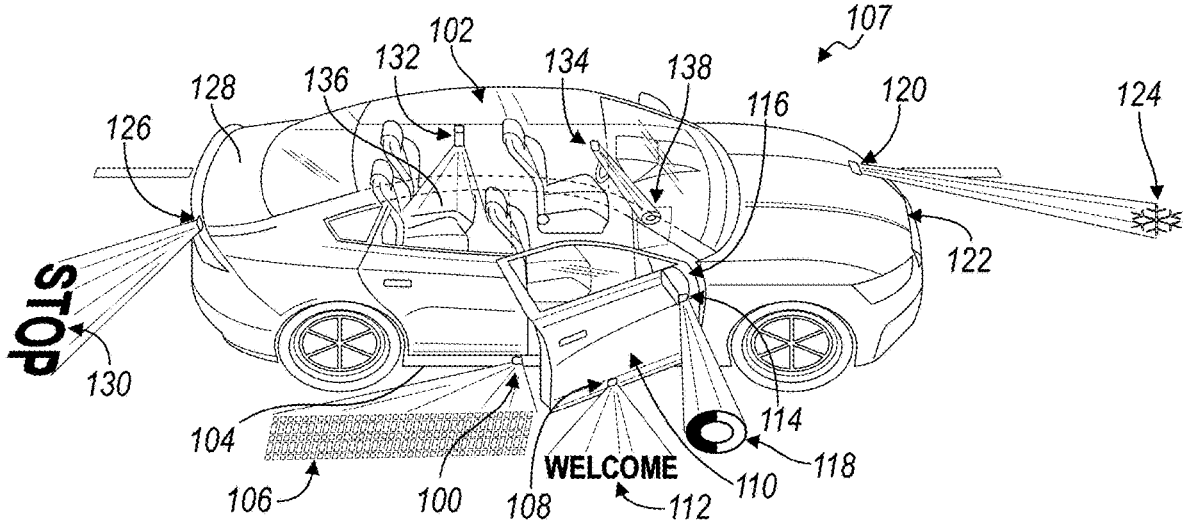
FIG. 1 is a side perspective view of a vehicle with a light projection system, including multiple lighting assemblies.

With reference to FIG. 1, a lighting assembly is illustrated in accordance with one or more embodiments and generally represented by numeral 100. The lighting assembly 100 is depicted within a vehicle 102 and mounted to a lower portion of a vehicle chassis 104, e.g., to a rocker panel. The lighting assembly 100 projects light in an illumination pattern that forms an image 106 laterally and downward from the vehicle 102 on the ground. The lighting assembly 100 projects light using multiple focal distances to provide an image with uniform intensity over an extended distance from the vehicle 102.

The lighting assembly 100 may be combined with other lighting assemblies within the vehicle 102 to provide a light projection system 107. The light projection system 107 may provide static or dynamic images to illuminate an area, convey information, or entertain. The light projection system 107 may include a second lighting assembly 108 that is mounted to a lower portion of a door 110 to provide a second image 112, e.g., a welcome message. The light projection system 107 may include a third lighting assembly 114 that is mounted to a lower portion of a side view mirror housing 116 to provide a third image 118, e.g., a logo. The light projection system 107 may also include a fourth lighting assembly 120 that is mounted to a bumper 122 to provide a fourth image 124, e.g., a weather indicator, on the ground in front of the vehicle 102 to communicate with the driver. The light projection system 107 may include a fifth lighting assembly 126 that is mounted to a trunk lid 128 to provide a fifth image 130, e.g., a vehicle status message, behind the vehicle 102 to communicate with the driver of a trailing vehicle (not shown). The light projection system 107 may also include a sixth lighting assembly 132 and a seventh lighting assembly 134 to project images within the vehicle interior on a glass surface 136, and a dash 138, respectively. Each lighting assembly is designed to accommodate a predetermined distance to a projection surface, surface texture, and an angle of illumination relative to an optical axis. The features described below with reference to the lighting assembly 100 may be implemented in other applications, e.g., the other lighting assemblies included in the light projection system 107.

Figure 2A:
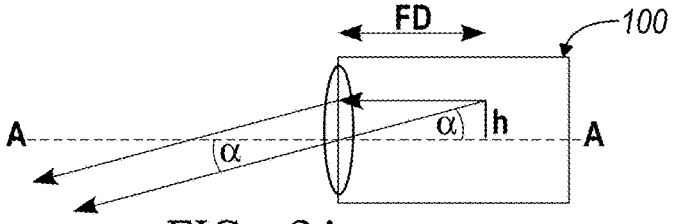
FIG. 2A is an enlarged view of a portion of the schematic diagram of FIG. 2.
Figure 2:
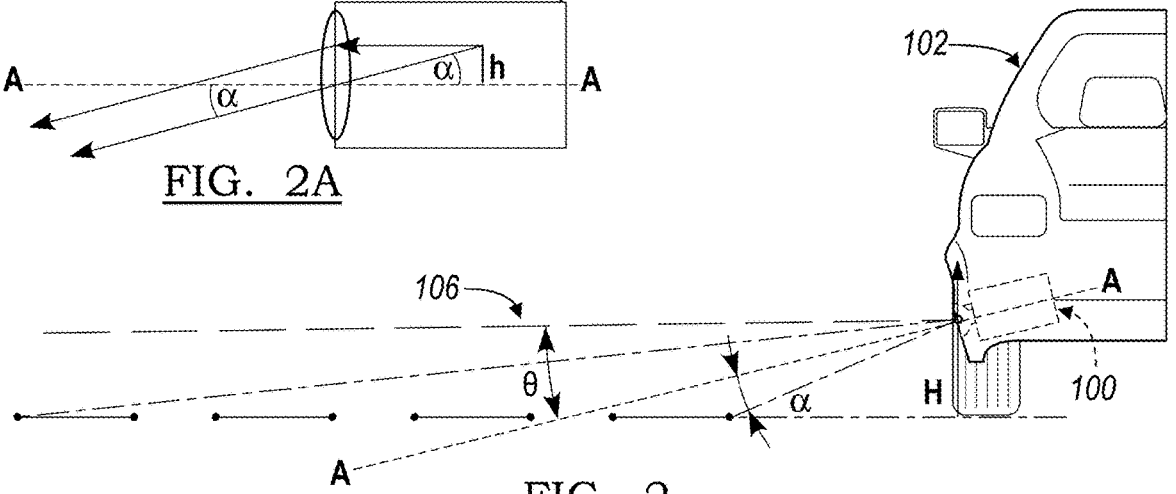
FIG. 2 is a front view of the vehicle of FIG. 1, illustrating a schematic diagram of a lighting assembly projecting light in an illumination pattern to form one or more images laterally from the vehicle.
Figure 3:
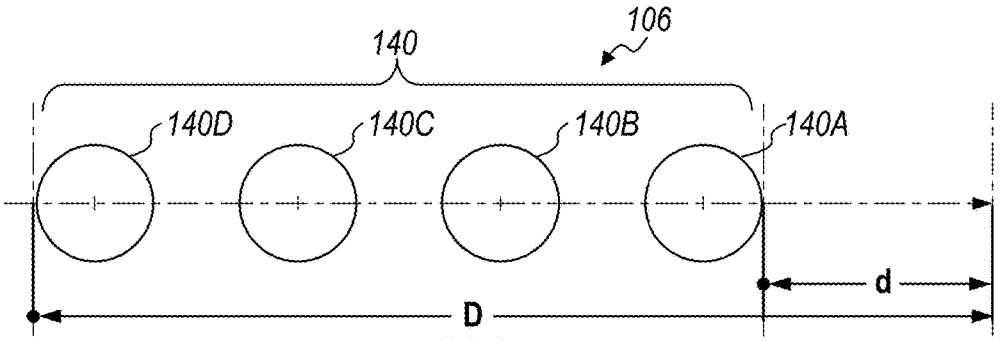
FIG. 3 is a top view of the image of FIG. 2.

Referring to FIGS. 2-3, the lighting assembly 100 projects light in an illumination pattern downward onto the ground and laterally outward from the vehicle 102 to form one or more images 106. The lighting assembly 100 may be mounted to a lower portion of the vehicle 102, such as to a rocker panel of the chassis 104, and vertically spaced apart from the ground at a vertical height (H) of approximately 180 to 220 mm. In one embodiment, H is approximately equal to 200 mm.

With reference to FIG. 3, the lighting assembly 100 projects light in the illumination pattern laterally outward from the vehicle 102 up to a maximum lateral distance (D). The illumination pattern is aligned about the optical axis A-A and may form one or more images 140A-140D between the maximum lateral distance (D) and a minimum lateral distance (d). In one or more embodiments, D is equal to 2,400 to 2,600 mm and d is equal to 500 to 700 mm. In one embodiment D is approximately equal to 2,500 mm and d is approximately equal to 600 mm. The lighting assembly 100 provides images with generally uniform intensity over an extended distance from the vehicle 102.

The lighting assembly 100 is mounted to the vehicle 102 such that its optical axis A-A is arranged at an offset angle (θ) relative to a horizontal axis toward a target lateral distance ($D_{target}$). The offset angle (θ) may be calculated based on $D_{target}$ and the vertical height (H) of the lighting assembly 100, according to the equation (1):

$$\tan(\theta) = \frac{H}{Dtarget} \tag{1}$$

In one embodiment, H is equal to 200 mm, $D_{target}$ is equal to 1000 mm and θ is equal to 11.3 degrees.

Figure 4:
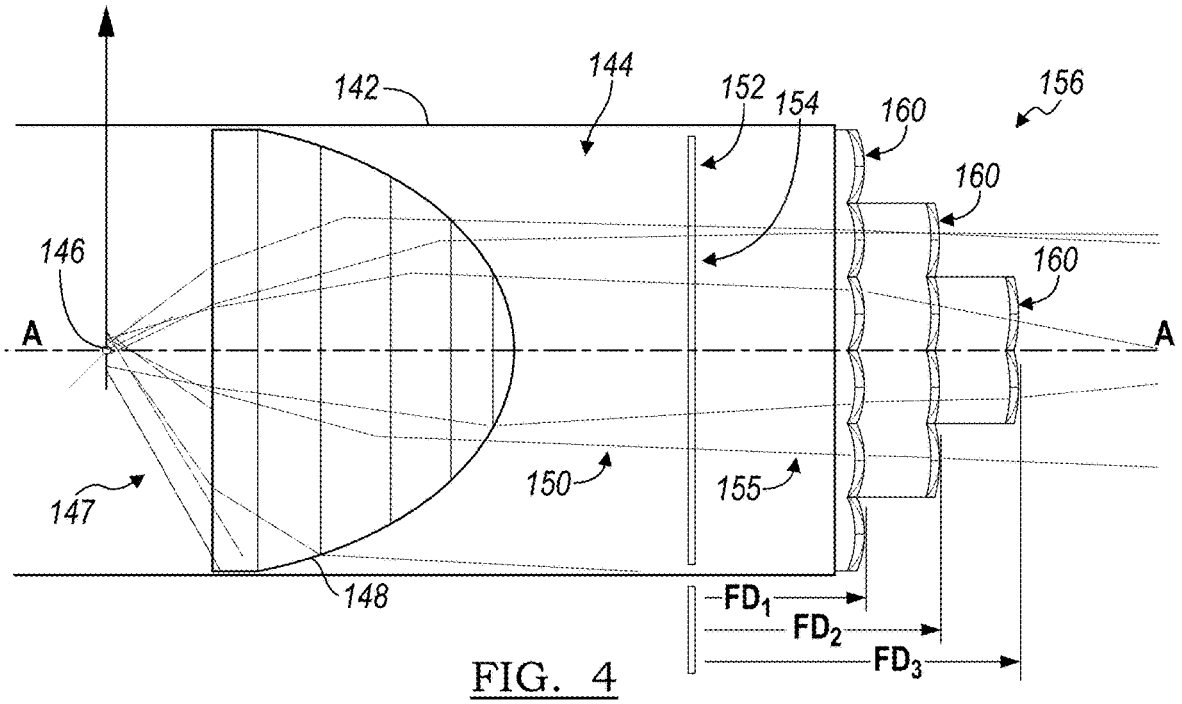
FIG. 4 is a side view of the lighting assembly of FIG. 2 according to one or more embodiments, including a single light source and an exit lens.

Referring to FIGS. 1 and 4, the lighting assembly 100 may provide a static image 106. The lighting assembly 100 includes a housing 142 that may be mounted to a lower portion of the vehicle 102. The housing 142 defines a cavity 144 that is aligned along the optical axis A-A. In one embodiment, the housing 142 is formed in a rectangular prism shape. The lighting assembly 100 includes a light source 146, such as a light emitting diode (LED) or laser diode, that is mounted within a rearward portion of the cavity 144 and emits light 147. The light source 146 may be mounted along the optical axis A-A. The lighting assembly 100 includes a collimator 148 that is mounted within the cavity 144 and centered about the optical axis A-A. The collimator 148 is a lens that receives the light 147 from the light source 146 and provides a series of light rays that are generally parallel to the optical axis A-A, which are collectively referred to as collimated light 150. The lighting assembly 100 also includes an image plate 152 with a series of apertures 154. The series of apertures 154 are formed in predetermined shapes to form the collimated light 150 into light segments 155 corresponding to the shape of the apertures 154.

Figure 5:
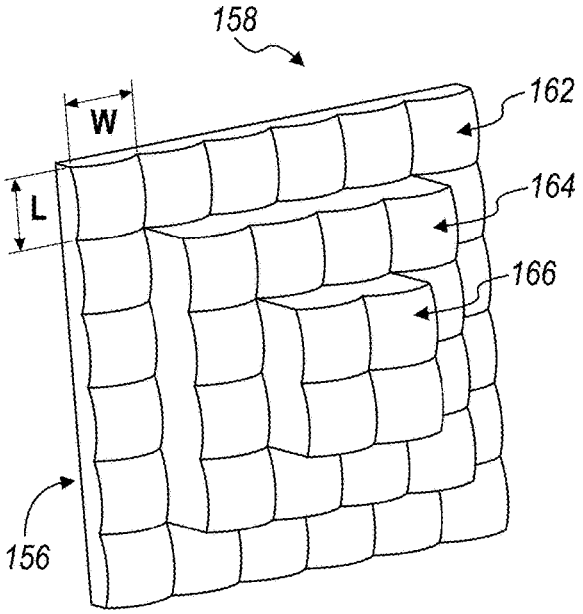
FIG. 5 is a front perspective view of a radially symmetric exit lens of the lighting assembly of FIG. 4, according to one or more embodiments.
Figure 6:
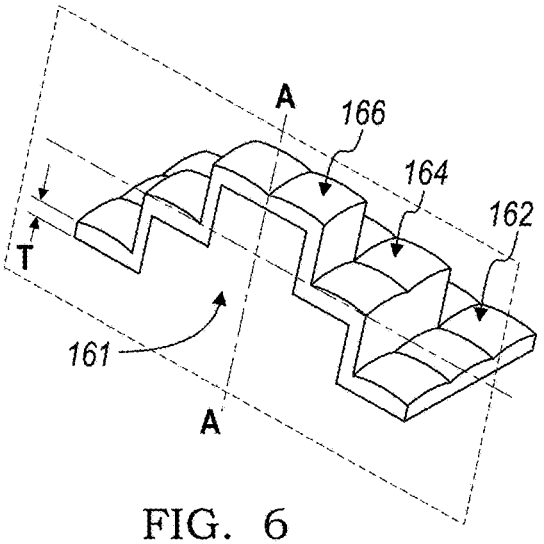
FIG. 6 is a sectional view of the radially symmetric exit lens of FIG. 5.

Referring to FIGS. 4-6, the lighting assembly 100 includes an exit lens 156 to focus the light segments 155 into the illumination pattern to form one or more images 106 on the ground (shown in FIG. 3). The exit lens 156 includes a plurality of optics 158 that have similar shapes. Each optic 158 has an aspherical exit surface 160 with a pillow shaped cross section. Each optic 158 has similar length (L) and width (W) dimensions, e.g., between 1 to 3 mm. In one embodiment, each optic 158 has a length (L) of approximately 2 mm and a width (W) of approximately 2 mm. As shown in FIG. 6, the exit lens 156 is cored out to define a cavity 161, such that a thickness (T) of each optic is between 1.1 mm and 1.9 mm.

The exit lens 156 illustrated in FIGS. 4-6 includes optics 158 that are arranged at three different focal distances from the image plate 152. The focal distance (FD), or focal length, refers to the longitudinal distance between the image plate 152 and each optic 158. The exit lens 156 includes a first series of optics 162, a second series of optics 164, and a third series of optics 166. As shown in FIG. 4, the first series of optics 162 are aligned on a common imaginary plane that is longitudinally spaced apart from the image plate 152 at a first focal distance ($FD_1$). The second series of optics 164 are aligned on a common imaginary plane that is longitudinally spaced apart from the image plate 152 at a second focal distance ($FD_2$). The third series of optics 166 are aligned on a common imaginary plane that is longitudinally spaced apart from the image plate 152 at a third focal distance ($FD_3$).

Referring back to FIG. 2A, the focal distance (FD) may be calculated based on the height (h) of an image on the image plate 152 and an angle (α) between the optical axis A-A and a line segment extending from h through a midpoint of a light cone representing an optic 158 as shown in Equation 2:

$$FD = \frac{h}{\tan(\alpha)} \tag{2}$$

The height of an image on the image plate 152 is represented by (h). An image on the image plate 152 refers to an aperture or region of apertures (shown in FIG. 21) that collectively provide an image 106. In one embodiment, $FD_1$, $FD_2$, and $FD_3$ are equal to approximately 5.0 mm, 7.6 mm, and 10.0 mm, respectively.

The exit lens 156 may be a radially symmetric exit lens that is formed in a pyramid shape. As shown in FIGS. 5 and 6, the first series of optics 162, the second series of optics 164, and the third series of optics 166, are each radially symmetric about the optical axis A-A at an angular rotation of 90 degrees. The third series of optics 166 is arranged proximal to the optical axis A-A, the first series of optics 162 is arranged distal to the optical axis A-A, and the second series of optics 166 is arranged between the first and third series of optics 162, 166. The first series of optics 162 focus the image segments at a large angle relative to optical axis A-A, e.g., 15 degrees. The second series of optics 164 focus the image segments at a medium angle relative to optical axis A-A, e.g., 10 degrees. The third series of optics 166 focus the image segments at a small angle relative to the optical axis A-A, e.g., 7.5 degrees. The pyramid shape of the exit lens 156 allows the lighting assembly 100 to maximize efficiency by minimizing shadows between optics having different thicknesses and corresponding focal distances.

Figure 7:
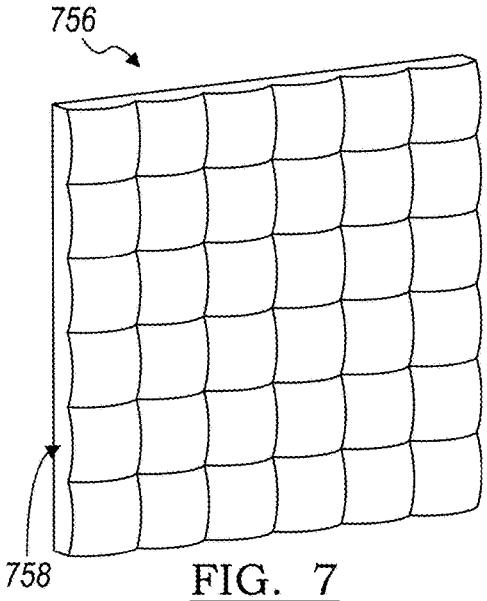
FIG. 7 is a front perspective view of an exit lens of the lighting assembly of FIG. 4, according to one or more embodiments.

FIGS. 7-10 illustrate lenses having different shapes and focal distances that may be implemented in the lighting assembly 100 of FIG. 4 to accommodate different applications, e.g., one of the other lighting assemblies illustrated in FIG. 1. FIG. 7 illustrates an exit lens 756 with a plurality of optics 758 having similar shapes. The plurality of optics 758 are arranged in an array on a single plane at a common focal distance. In one embodiment, the exit lens 756 includes a 6×6 array of optics 758.

Figure 8:
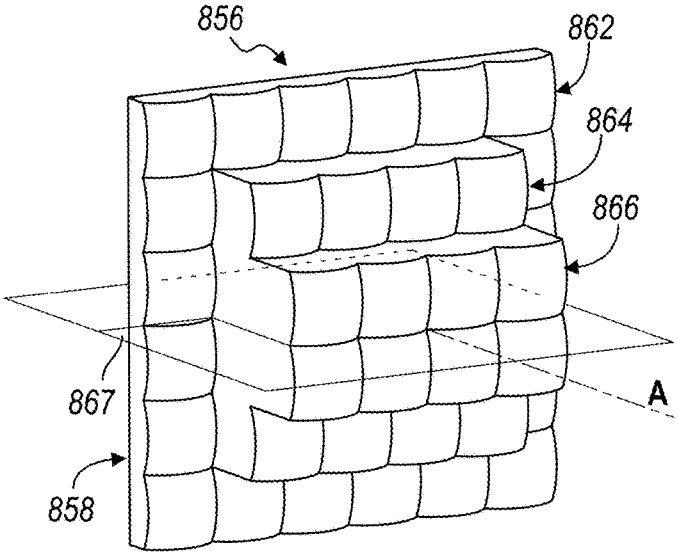
FIG. 8 is a front perspective view of a bilaterally symmetric exit lens of the lighting assembly of FIG. 4, according to one or more embodiments.

FIG. 8 illustrates an exit lens 856 with a plurality of optics 858, that are arranged at three different focal distances. Similar to the exit lens 156 of FIG. 5, the exit lens 856 includes a first series of optics 862, a second series of optics 864, and a third series of optics 866 that are arranged at a first focal distance, a second focal distance, and a third focal distance, respectively. The third series of optics 866 includes more optics than the third series of optics 166 of the exit lens 156 of FIG. 5, such that the exit lens 856 is bilaterally symmetric about a horizontal plane 867, or radially symmetric about the optical axis A-A at an angular rotation of 180 degrees, unlike the exit lens 156 of FIG. 5 which is radially symmetric at an angular rotation of 90 degrees.

Figure 9:
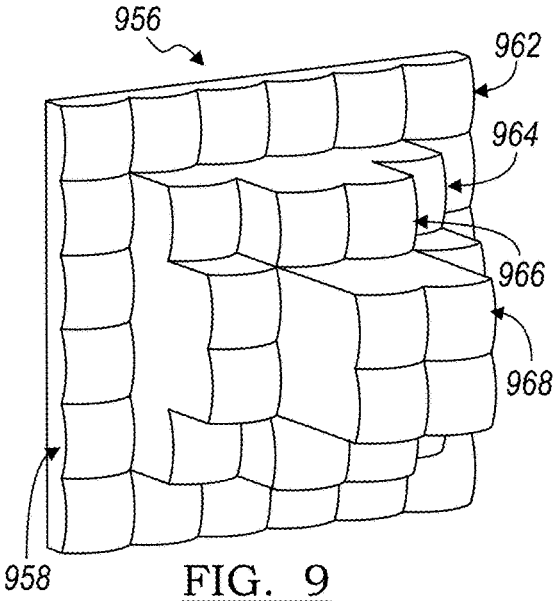
FIG. 9 is a front perspective view of another radially symmetric exit lens of the lighting assembly of FIG. 4, according to one or more embodiments.

FIG. 9 illustrates an exit lens 956 with a plurality of optics 958 that are arranged at four focal distances. The exit lens 956 includes a first series of optics 962, a second series of optics 964, a third series of optics 966, and a fourth series of optics 968 that are arranged at a first focal distance, a second focal distance, a third focal distance, and a fourth focal distance, respectively. The four series of optics 962, 964, 966, 968 are all radially symmetric about the optical axis A-A at an angular rotation of 90 degrees, like the exit lens 156 of FIG. 5.

Figure 10:
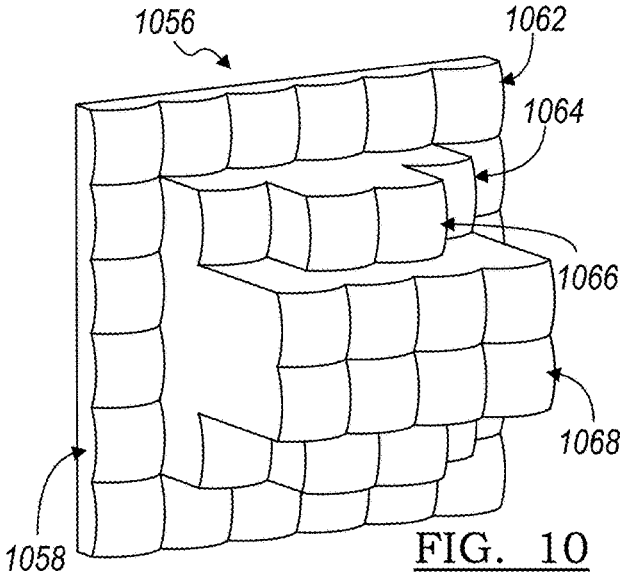
FIG. 10 is a front perspective view of another bilaterally symmetric exit lens of the lighting assembly of FIG. 4, according to one or more embodiments.

FIG. 10 illustrates another exit lens 1056 with a plurality of optics 1058 that are arranged at four focal distances. The exit lens 1056 includes a first series of optics 1062, a second series of optics 1064, a third series of optics 1066, and a fourth series of optics 1068 that are arranged at four different focal distances. The four series of optics 1062, 1064, 1066, 1068 are bilaterally symmetric about a horizontal plane (not shown), or radially symmetric about the optical axis A-A at an angular rotation of 180 degrees, like the exit lens 856 of FIG. 8.

FIGS. 11-14 illustrate the impact of the shape of the exit lens, including the number of focal distances and the number of optics at each focal distance, on the intensity of the far field image generated by the lighting assembly 100 with a light source 146 of 100 lumens, by capturing the luminous flux distribution represented on candela distribution graphs. Luminous flux is measured in lumens and represents the perceived power of light by the human eye.

Figure 11:
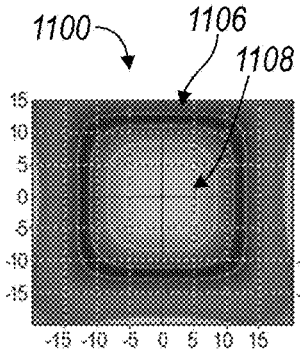
FIG. 11 is a far field image generated by the lighting assembly of FIG. 4 with the exit lens of FIG. 7.
Figure 12:
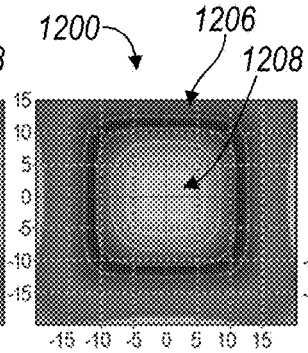
FIG. 12 is a far field image generated by the lighting assembly of FIG. 4 with the radially symmetric exit lens of FIG. 5.

FIG. 11 is a graph 1100 of the far field image 1106 generated by the lighting assembly 100 with the exit lens 756 of FIG. 7, which includes a single focal distance. FIG. 12 is a graph 1200 of the far field image 1206 generated by the lighting assembly 100 with the radially symmetric exit lens 156 of FIG. 5 that includes three focal distances. The perceived power of the light projected by the lighting assembly 100 increases with increasing focal distance and the number of different focal distances. For example, the exit lens 156 of FIG. 5, with three focal distances, generates a peak intensity of 374 Candela (Cd), as represented by numeral 1208 in graph 1200; whereas the exit lens 756 of FIG. 7, with one focal distance, generates a peak intensity of 350 Cd, as represented by numeral 1108 in graph 1100.

Figure 13:
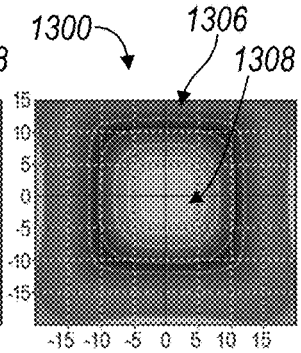
FIG. 13 is a far field image generated by the lighting assembly of FIG. 4 with the bilaterally symmetric exit lens of FIG. 8.

FIG. 13 is a graph 1300 of the far field image 1306 generated by the lighting assembly 100 with the bilaterally symmetric exit lens 856 of FIG. 8, which includes three focal distances. As the number of optics at a focal distance increases, the perceived power of the light projected by the lighting assembly 100 increases. For example, the exit lens 856 of FIG. 8, with eight optics at the third focal distance, generates a peak intensity of 413 Cd, as represented by numeral 1308 in graph 1300; whereas the exit lens 156 of FIG. 5, with four optics at the third focal distance, again generates a peak intensity of 374 Cd, as represented by numeral 1208 in graph 1200.

Figure 14:
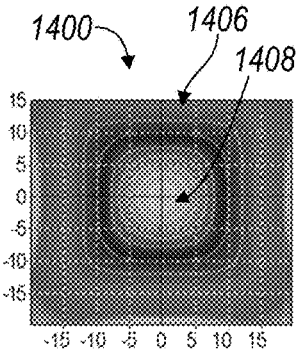
FIG. 14 is a far field image generated by the lighting assembly of FIG. 4 with the radially symmetric exit lens of FIG. 9.

FIG. 14 is a graph 1400 of the far field image 1406 generated by the lighting assembly 100 of FIG. 4 with the radially symmetric exit lens 956 of FIG. 9, which includes four focal distances. As described above for FIG. 12, the perceived power of the light projected by the lighting assembly 100 increases with increasing focal distance and the number of different focal distances. For example, the exit lens 956 of FIG. 9, with four focal distances, generates a peak intensity of 463 Cd, as represented by numeral 1408 in graph 1400; whereas the exit lens 156 of FIG. 5, with three focal distances, generates a peak intensity of 374 Cd, as represented by numeral 1208 in graph 1200.

Figure 15:
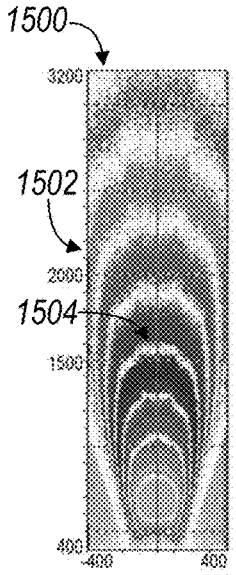
FIG. 15 illustrates a ground illumination pattern generated by the lighting assembly of FIG. 4 with the exit lens of FIG. 7.
Figure 16:
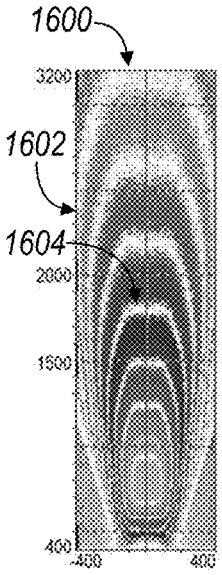
FIG. 16 illustrates a ground illumination pattern generated by the lighting assembly of FIG. 4 with the radially symmetric exit lens of FIG. 5.
Figure 17:
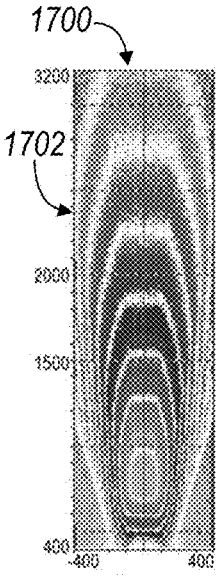
FIG. 17 illustrates a ground illumination pattern generated by the lighting assembly of FIG. 4 with the bilaterally symmetric exit lens of FIG. 8.
Figure 18:
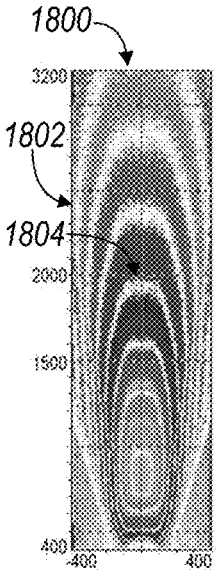
FIG. 18 illustrates a ground illumination pattern generated by the lighting assembly of FIG. 4 with the radially symmetric exit lens of FIG. 9.
Figure 19:
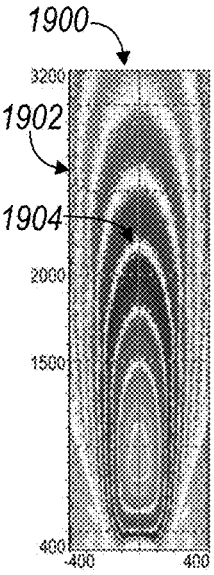
FIG. 19 illustrates a ground illumination pattern generated by the lighting assembly of FIG. 4 with the bilaterally symmetric exit lens of FIG. 10.
Figure 20:
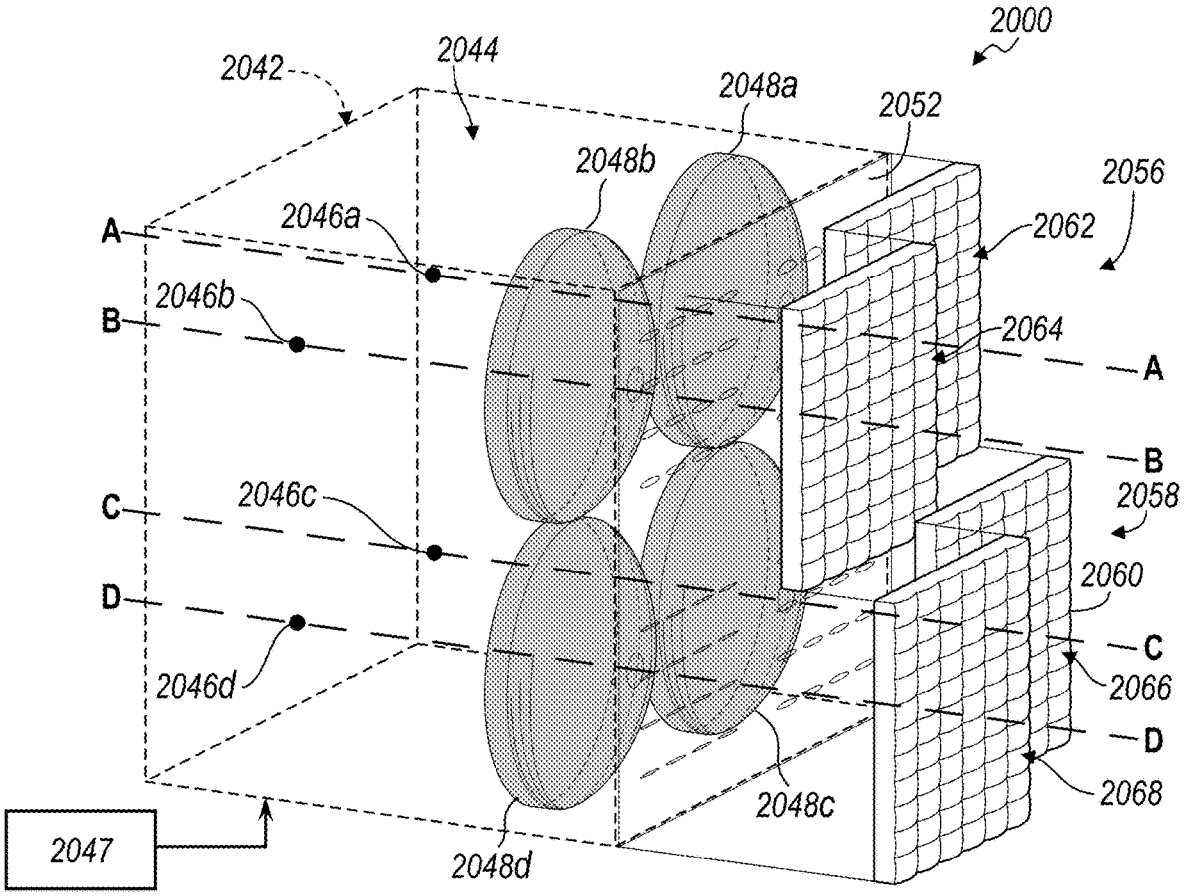
FIG. 20 is a side perspective view of the lighting assembly of FIG. 2 according to another embodiment, including multiple light sources and an exit lens.

FIGS. 15-19 further illustrate the impact of the shape of the exit lens, including the number of focal distances and the number of optics at each focal distance, on the intensity of the image. FIG. 15 is a graph 1500 illustrating a ground illumination pattern 1502 generated by the lighting assembly 100 with the exit lens 756 of FIG. 7, which includes a single focal distance. FIG. 16 is a graph 1600 illustrating a ground illumination pattern 1602 generated by the lighting assembly 100 with the radially symmetric exit lens 156 of FIG. 5, which includes three focal distances, and four optics at the third focal distance. FIG. 17 is a graph 1700 illustrating a ground illumination pattern 1702 generated by the lighting assembly 100 with the bilaterally symmetric exit lens 856 of FIG. 8, which includes three focal distances, and eight optics at the third focal distance. FIG. 18 is a graph 1800 illustrating a ground illumination pattern 1802 generated by the lighting assembly 100 with the radially symmetric exit lens 956 of FIG. 9, which includes four focal distances, and four optics at the fourth focal distance. FIG. 19 is a graph illustrating a ground illumination pattern 1902 generated by the lighting assembly 100 with the bilaterally symmetric exit lens 1056 of FIG. 10, which includes four focal distances, and eight optics at the fourth focal distance.

Referring to FIGS. 15, 16, and 18, by increasing the focal distance and/or the number of focal distances of the exit lens, the lighting assembly 100 may provide a high intensity image farther away from the vehicle. For example, a lighting assembly 100 with the exit lens 756 of FIG. 7, which includes one focal distance, generates a portion of the illumination pattern 1502 up to a distance of approximately 1600 mm, as represented by numeral 1504 in graph 1500 of FIG. 15. Whereas a lighting assembly 100 with the exit lens 156 of FIG. 5, which includes three focal distances, generates a portion of the illumination pattern 1602 with a similar brightness up to a distance of approximately 1800 mm, as represented by numeral 1604 in graph 1600 of FIG. 16. Further, a lighting assembly 100 with the exit lens 956 of FIG. 9, which includes four focal distances, generates a portion of the illumination pattern 1802 with a similar brightness up to a distance of approximately 1900 mm, as represented by numeral 1804 in graph 1800 of FIG. 18.

Referring to FIGS. 18 and 19, by increasing the number of optics at a focal distance, the lighting assembly 100 may provide a high intensity image farther away from the vehicle. For example, a lighting assembly 100 with the exit lens 1056 of FIG. 10, which includes eight optics at the fourth focal distance, generates a portion of the illumination pattern 1902 up to a distance of approximately 2200 mm, as represented by numeral 1904 in graph 1900 of FIG. 19. Whereas a lighting assembly 100 with the exit lens 956 of FIG. 9, which includes four optics at the fourth focal distance, generates a portion of the illumination pattern 1802 with a similar brightness up to a distance of approximately 1900 mm, as represented by numeral 1804 in graph 1800 of FIG. 18.

FIGS. 20-34 illustrate a lighting assembly 2000 that may provide a dynamic image 2002, that includes multiple independently controlled image segments, e.g., a first image segment 2006, a second image segment 2016, a third image segment 2026, and a fourth image segment 2036 (shown in FIGS. 31-34). With reference to 20, the lighting assembly 2000 includes a housing 2042 that may be mounted to a lower portion of the vehicle 102 (FIG. 1). The housing 2042 defines a cavity 2044 that is aligned along four parallel optical axis A-A, B-B, C-C, and D-D. In one embodiment, the housing 2042 is formed in a rectangular prism shape.

The lighting assembly 2000 includes four light sources 2046*a*, 2046*b*, 2046*c*, and 2046*d*, such as a light emitting diode (LED) or laser diode, that are mounted within a rearward portion of the cavity 2044 and emit light (not shown). The lighting assembly 2000 also includes a controller 2047 that is connected to each light source 2046*a*, 2046*b*, 2046*c*, and 2046*d* to independently control the light sources. Although the controller 2047 is shown as a single controller, it may contain multiple controllers, or may be embodied as software code within one or more other vehicle controllers (not shown). The controller 2047 generally includes any number of microprocessors, ASICs, ICs, memory (e.g., FLASH, ROM, RAM, EPROM and/or EEPROM) and software code to co-act with one another to perform a series of operations. Such hardware and/or software may be grouped together in assemblies to perform certain functions. Any one or more of the controllers or devices described herein include computer executable instructions that may be compiled or interpreted from computer programs created using a variety of programming languages and/or technologies. In general, a processor (such as a microprocessor) receives instructions, for example from a memory, a computer-readable medium, or the like, and executes the instructions. A processing unit includes a non-transitory computer-readable storage medium capable of executing instructions of a software program. The computer readable storage medium may be, but is not limited to, an electronic storage device, a magnetic storage device, an optical storage device, an electromagnetic storage device, a semi-conductor storage device, or any suitable combination thereof. The controller 2047, also includes predetermined data, or "look up tables" that are stored within memory, according to one or more embodiments.

The light sources 2046*a*, 2046*b*, 2046*c*, and 2046*d* are mounted along optical axes A, B, C, and D, respectively. The lighting assembly 2000 includes four collimators 2048*a*, 2048*b*, 2048*c*, and 2048*d* that are mounted within the cavity 2044 and centered about optical axes A, B, C, and D, respectively. Each collimator 2048*a*, 2048*b*, 2048*c*, and 2048*d* is a lens that receives light from the corresponding light source 2046*a*, 2046*b*, 2046*c*, and 2046*d* and provides a series of collimated light rays that are generally parallel to the corresponding optical axes A, B, C, and D. The lighting assembly 2000 also includes an image plate 2052 with four regions of apertures 2054*a*, 2054*b*, 2054*c*, and 2054*d* (shown in FIG. 21) that are formed in predetermined shapes to form the collimated light into light segments corresponding to the shape of the apertures.

The lighting assembly 2000 also includes an exit lens 2056 to focus the light segments into the illumination pattern to form the image 2002. The exit lens 2056 includes a plurality of optics 2058 that have similar shapes with aspherical exit surfaces 2060 and pillow shaped cross sections. The plurality of optics 2058 are arranged at four different focal distances from the image plate 2052. The plurality of optics 2058 includes a first series of optics 2062, a second series of optics 2064, a third series of optics 2066, and a fourth series of optics 2068 that are arranged at a first focal distance, a second focal distance, a third focal distance, and a fourth focal distance, respectively.

Figure 21:
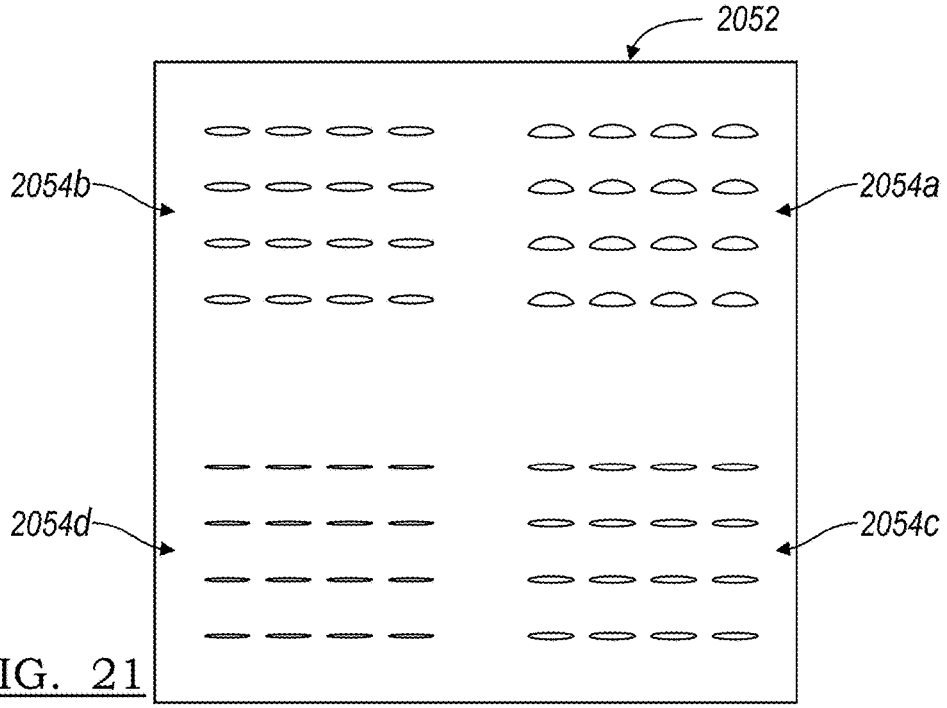
FIG. 21 is a front view of an image plate of the lighting assembly of FIG. 20, illustrating four regions corresponding to four different focal distances.

With reference to FIG. 21, the image plate 2052 includes a plurality of apertures that are arranged into regions of similarly shaped apertures. The plurality of apertures include a first region of apertures 2054*a*, a second region of apertures 2054*b*, a third region of apertures 2054*c*, and a fourth region of apertures 2054*d* that are formed in predetermined shapes to form the collimated light into light segments corresponding to the shape of the apertures.

Figure 22:
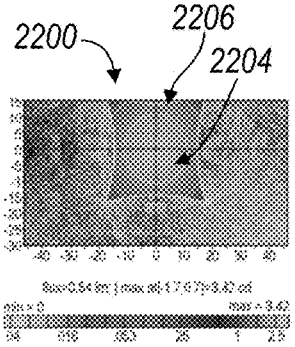
FIG. 22 is a far field image generated by the lighting assembly of FIG. 20 with light focused by a first series of optics of the exit lens.
Figure 23:
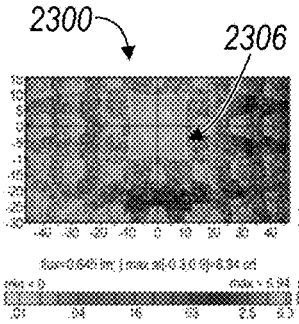
FIG. 23 is a far field image generated by the lighting assembly of FIG. 20 with light focused by a second series of optics of the exit lens.
Figure 24:
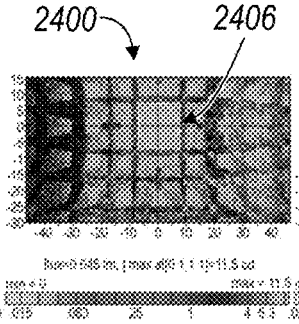
FIG. 24 is a far field image generated by the lighting assembly of FIG. 20 with light focused by a third series of optics of the exit lens.
Figure 25:
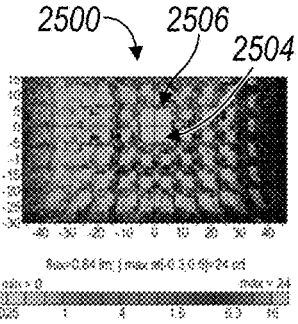
FIG. 25 is a far field image generated by the lighting assembly of FIG. 20 with light focused by a fourth series of optics of the exit lens.

FIGS. 22-25 illustrate the impact of the focal distance of the lens on the intensity of the far field image generated by the lighting assembly 2000 with light sources 2046*a-d* of 100 lumens, by capturing the luminous flux distribution represented on candela distribution graphs. FIG. 22 is a graph 2200 of the far field image 2206 generated by the first series of optics 2062 of the exit lens 2056 of the lighting assembly 2000. FIG. 23 is a graph 2300 of the far field image 2306 generated by the second series of optics 2064 of the exit lens 2056 of the lighting assembly 2000. FIG. 24 is a graph 2400 of the far field image 2406 generated by the third series of optics 2066 of the exit lens 2056 of the lighting assembly 2000. FIG. 25 is a graph 2500 of the far field image 2506 generated by the fourth series of optics 2068 of the exit lens 2056 of the lighting assembly 2000.

Referring to FIGS. 22 and 25, the perceived power of the light projected by the lighting assembly 2000 increases with increasing focal distance. For example, the first series of optics 2062 of the exit lens 2056 at the shortest focal distance (first focal distance) generates a peak intensity of 341 Cd, as represented by numeral 2204 in graph 2200 of FIG. 22; whereas the fourth series of optics 2068 of the exit lens 2056 at the longest focal distance (fourth focal distance) generates a peak intensity of 2,400 Cd, as represented by numeral 2504 in graph 2500 of FIG. 25.

Figure 26:
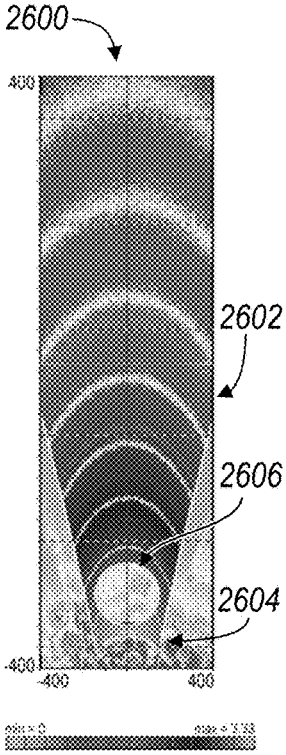
FIG. 26 illustrates a ground illumination pattern generated by the lighting assembly of FIG. 20 with light focused by the first series of optics of the exit lens.
Figure 27:
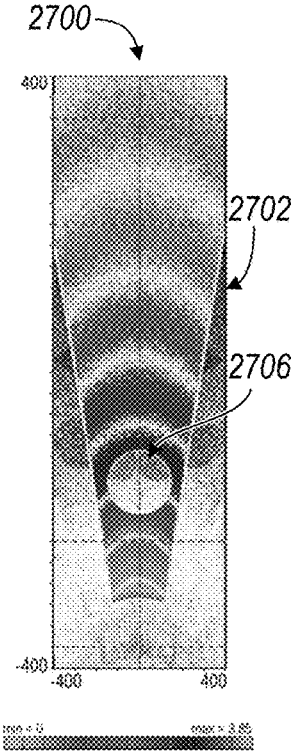
FIG. 27 illustrates a ground illumination pattern generated by the lighting assembly of FIG. 20 with light focused by the second series of optics of the exit lens.
Figure 28:
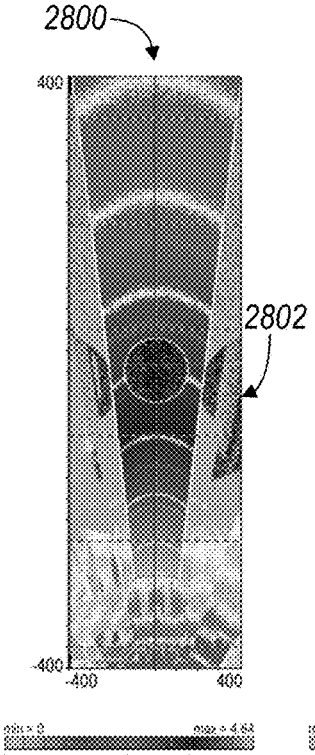
FIG. 28 illustrates a ground illumination pattern generated by the lighting assembly of FIG. 20 with light focused by the third series of optics of the exit lens.
Figure 29:
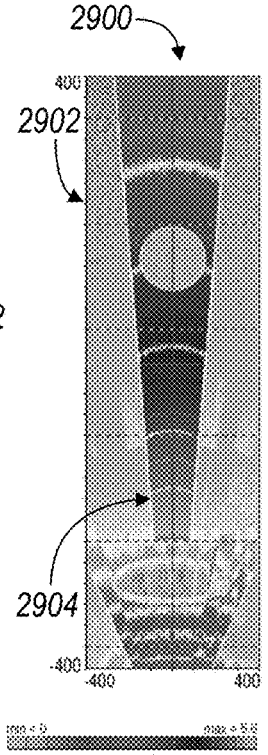
FIG. 29 illustrates a ground illumination pattern generated by the lighting assembly of FIG. 20 with light focused by the fourth series of optics of the exit lens.

FIGS. 26-29 illustrate the impact of the focal distance of the exit lens on the intensity of image. FIG. 26 is a graph 2600 illustrating a ground illumination pattern 2602 generated by the first series of optics 2062 of the exit lens 2056 of the lighting assembly 2000 at the first focal distance. FIG. 27 is a graph 2700 illustrating a ground illumination pattern 2702 generated by the second series of optics 2064 of the exit lens 2056 of the lighting assembly 2000 at the second focal distance. FIG. 28 is a graph 2800 illustrating a ground illumination pattern 2802 generated by the third series of optics 2066 of the exit lens 2056 of the lighting assembly 2000 at the third focal distance. FIG. 29 is a graph 2900 illustrating a ground illumination pattern 2902 generated by the fourth series of optics 2068 of the exit lens 2056 of the lighting assembly 2000 at the fourth focal distance. Graphs 2600-2900 illustrate the region within each illumination pattern where the light distribution narrows on the ground, and that is what makes the regions of interest similar in brightness.

Figure 30:
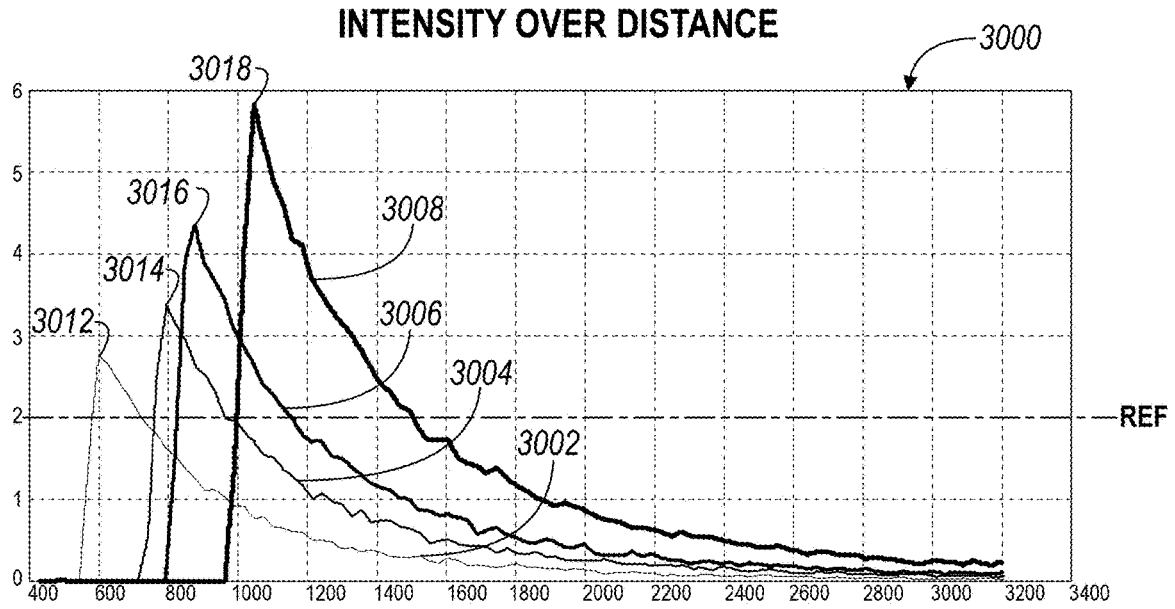
FIG. 30 is a graph illustrating the light intensity (LUX), generated by the lighting assembly of FIG. 20, of the ground illumination over the lateral distance for the first, second, third, and fourth series of optics.

FIG. 30 is a graph 3000 illustrating four curves representing the light intensity (LUX) of the ground illumination over the lateral distance from the vehicle for the different light sources and a reference curve (REF) that represents a threshold intensity level. The first curve 3002 represents the light intensity over distance of the image provided by the first light source 2046*a* and corresponding first series of optics 2062. This first combination provides an image with a maximum intensity of approximately 2.7 lux at 600 mm, as referenced by numeral 3012. The second curve 3004 represents the light intensity over distance of the image provided by the second light source 2046*b* and corresponding second series of optics 2064. This second combination provides an image with a maximum intensity of approximately 3.1 lux at 800 mm, as referenced by numeral 3014.

The third curve 3006 represents the light intensity over distance of the image provided by the third light source 2046*c* and corresponding third series of optics 2066. This third combination provides an image with a maximum intensity of approximately 4.3 lux at 900 mm, as referenced by numeral 3016. The fourth curve 3008 represents the light intensity over distance of the image provided by the fourth light source 2046*d* and corresponding fourth series of optics 2068. This fourth combination provides an image with a maximum intensity of approximately 5.8 lux at 1050 mm, as referenced by numeral 3018.

With reference to FIGS. 31-34 the lighting assembly 2000 provides a dynamic image 2002, that includes multiple independently controlled image segments, e.g., a first image segment 2006, a second image segment 2016, a third image segment 2026, and a fourth image segment 2036.

The lighting assembly 2000 creates image segments at different locations by blocking portions of the collimated light with the image plate 2052. For example, the controller

Figure 31:
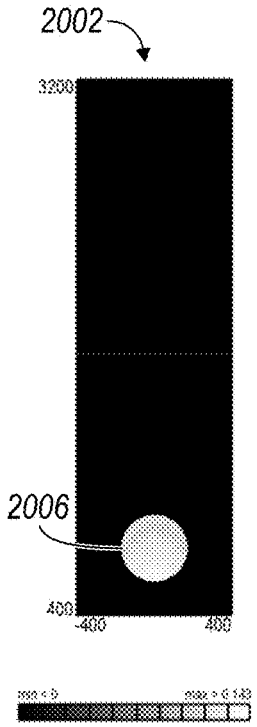
FIG. 31 illustrates a projected image generated by the lighting assembly of FIG. 20 with light focused by the first series of optics of the exit lens.
Figure 32:
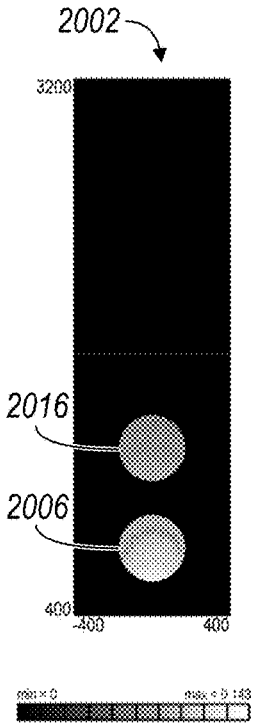
FIG. 32 illustrates two projected images generated by the lighting assembly of FIG. 20 with light focused by the first series of optics and the second series of optics of the exit lens.

2047 may enable, or turn on, the first light source 2046*a*, and the first series of apertures 2054*a* of the image plate 2052 may pass light segments that are then focused by the first series of optics 2062 to form the first image segment 2006 between 500-700 mm, as shown in FIG. 31. Similarly, the controller 2047 may enable the second light source 2046*b*, and the second series of apertures 2054*b* of the image plate 2052 may pass light segments that are then focused by the second series of optics 2064 to form the second image segment 2016 between 700-900 mm, as shown in FIG. 32.

Figure 33:
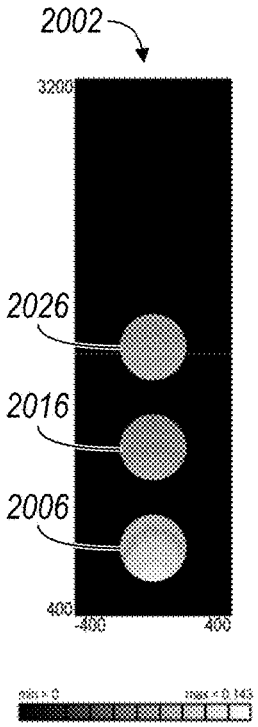
FIG. 33 illustrates three projected images generated by the lighting assembly of FIG. 20 with light focused by the first, second, and third series of optics of the exit lens.
Figure 34:
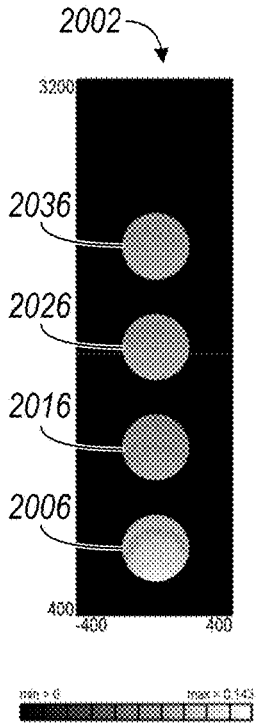
FIG. 34 illustrates four projected images generated by the lighting assembly of FIG. 20 with light focused by the first, second, third, and fourth series of optics of the exit lens.

The controller 2047 may enable the third light source 2046*c*, and the third series of apertures 2054*c* of the image plate 2052 may pass light segments that are then focused by the third series of optics 2064 to form the third image segment 2026 between 900-1100 mm, as shown in FIG. 33. Similarly, the controller 2047 may enable the fourth light source 2046*d*, and the fourth series of apertures 2054*d* of the image plate 2052 may pass light segments that are focused by the fourth series of optics 2064 to form the fourth image segment 2036 between 1100-1300 mm, as shown in FIG. 34.

The controller 2047 may enable and disable the light sources 2046*a*-2046*c* collectively or individually. By enabling the light sources 2046*a*-2046*c* individually, the light assembly 2000 may provide a dynamic image 2002. For example, the controller 2047 may enable the light sources 2046*a*-2046*c* individually in a sequence as shown in FIGS. 31-34 to simulate the image 2002 extending away from the vehicle 102.

Figure 35:
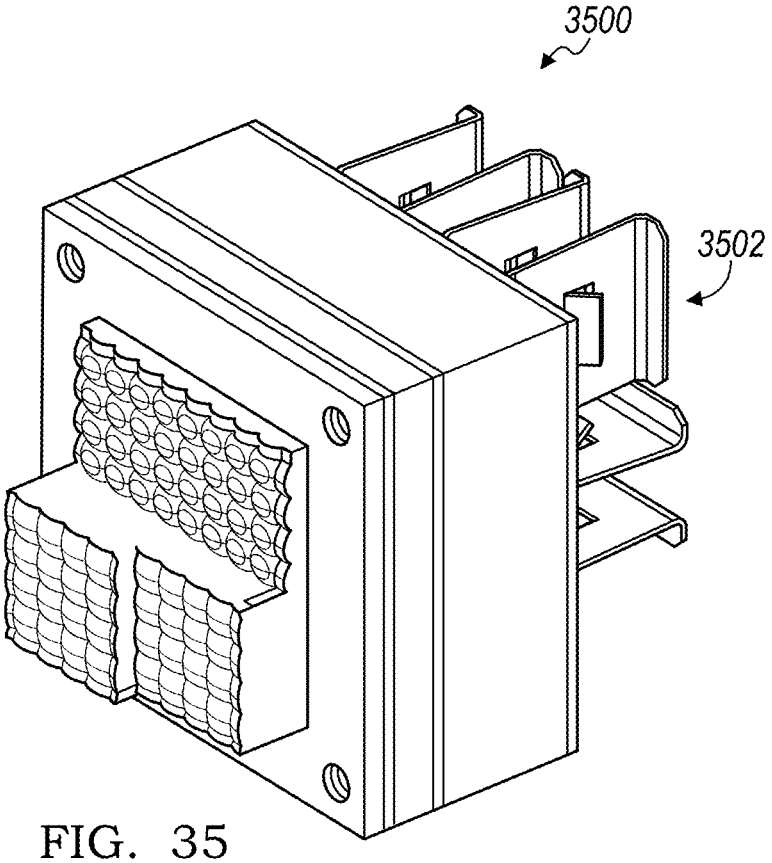
FIG. 35 is a front perspective view of a portion of the lighting assembly of FIG. 4 with a heat sink.
Figure 36:
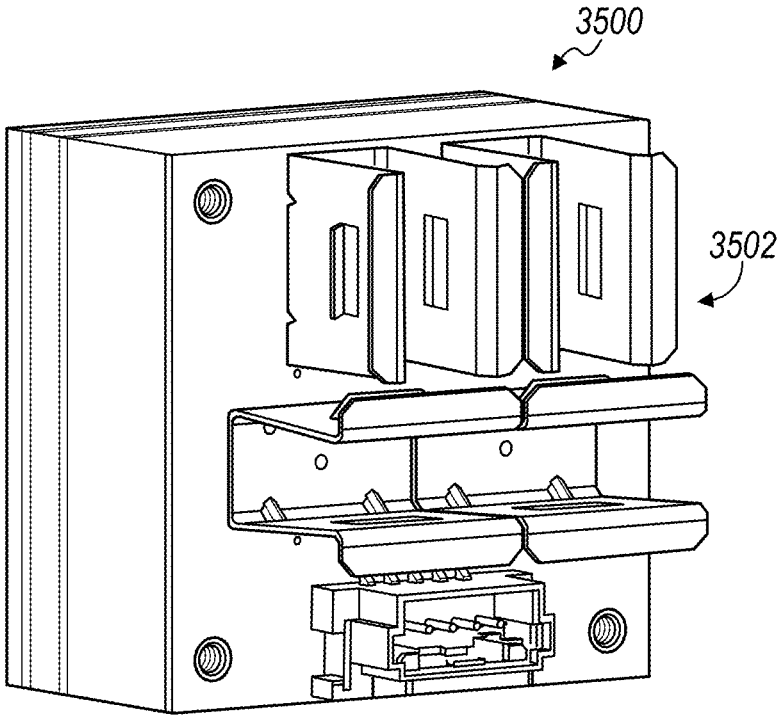
FIG. 36 is a rear perspective view of the lighting assembly of FIG. 35.

FIGS. 35-36 illustrate a lighting assembly 3500 that includes a plurality of heat sinks 3502 that extend from the housing 142. The lighting assembly 3500, like the lighting assembly 2000 of FIGS. 20-34, includes multiple light sources (not shown) that may be individually controlled to provide a dynamic image. Such light sources generate heat during operation. The heat sinks 3502 dissipate this heat, which reduces the operating temperature of the lighting assembly 3500. By using minimal low power light sources, such as LEDs, and heat sinks, the lighting assembly 3500 may use lenses, e.g., the collimator and exit lens, that are formed of a polymer instead of glass, which reduces cost.

The lighting assembly 100, 2000, 3500 utilizes an exit lens with multiple focal distances to gain adjustability in the far field pattern intensities to provide a uniform intensity over distance. This approach provides benefits over existing projection lighting systems which exhibit the natural exponential decline of the light over distance. The exit lens includes optics with different focal distances to illuminate portions of the image at different locations. The lighting assembly 100, 2000, 3500 includes a plurality of optics arranged at different focal distances from a single image generation plane, which multiplies the image by the number of optics, and compensates for any partially blocked optics or particles on the exit lens which would otherwise create a shadow on the image.

The lighting assembly includes a light source, a collimator, an image plate, and an exit lens with large pillow shaped optics. The lighting assembly does not include micro-optics, which would require precise alignment with other lenses and the image plate. Therefore, the lighting assembly provides cost improvements over existing light projection systems that utilize such micro-optics. The lighting assembly also uses a simple image plate rather than micro images on the optics themselves.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A lighting assembly comprising:

a housing defining a cavity that is aligned along a longitudinal axis;

at least one light source supported by the housing and aligned with the longitudinal axis;

at least one lens supported by the housing to collimate light from the light source; and an image plate with a plurality of apertures formed through to pass a portion of the collimated light as light segments; and an exit lens comprising:

a first series of optics arranged on a first plane spaced apart from the image plate at a first focal distance to focus the light segments at a first distance from the housing, and a second series of optics arranged on a second plane spaced apart from the image plate at a second focal distance to focus the light segments at a second distance from the housing, wherein the second focal distance is greater than the first focal distance.

2. The lighting assembly of claim 1, wherein the first series of optics focus the light segments toward a surface in a first illumination pattern, wherein the second series of optics focus the light segments toward the surface in a second illumination pattern, and wherein the first illumination pattern and the second illumination pattern collectively form an image on the surface.

3. The lighting assembly of claim 1, wherein the first series of optics focus the light segments at the first distance from the housing at a first intensity level, wherein the second series of optics focus the light segments at the second distance from the housing at a second intensity level, and wherein both the first intensity level and the second intensity level are greater than a threshold intensity level.

4. The lighting assembly of claim 1, wherein the second series of optics are arranged in a radially symmetric pattern.

5. The lighting assembly of claim 1, wherein the second series of optics are arranged in a bilaterally symmetric pattern.

6. The lighting assembly of claim 1, wherein the second series of optics comprises a plurality of optics that are each formed with a length and a width that are each at least one millimeter.

7. The lighting assembly of claim 1, wherein the second series of optics comprises a plurality of optics that are each formed with an aspherical cross section.

8. The lighting assembly of claim 1, wherein the exit lens is integrally formed.

9. The lighting assembly of claim 1, wherein the exit lens further comprises a third series of optics arranged on a third plane spaced apart from the image plate at a third focal distance to focus the light segments at a third distance from the housing, wherein the third focal distance is greater than the second focal distance.

10. The lighting assembly of claim 9, wherein the exit lens further comprises a fourth series of optics arranged on a fourth plane spaced apart from the image plate at a fourth focal distance to focus the light segments at a fourth distance from the housing, wherein the fourth focal distance is greater than the third focal distance.

11. The lighting assembly of claim 1, wherein the at least one light source comprises a first light source, and a second light source that is spaced apart from the first light source;

wherein the at least one lens comprises a first lens supported by the housing to collimate light from the first light source, and a second lens supported by the housing to collimate light from the second light source;

wherein the image plate further comprises a first plurality of apertures formed through to pass a first portion of the collimated light from the first lens as first light segments, and a second plurality of apertures formed through to pass a second portion of the collimated light from the second lens as second light segments;

wherein the first series of optics are aligned with the first plurality of apertures to focus the first light segments at the first distance from the housing; and wherein the second series of optics are aligned with the second plurality of apertures to focus the second light segments at the second distance from the housing.

12. The lighting assembly of claim 11 further comprising a controller to independently control the first light source and the second light source to provide a dynamic image.

13. The lighting assembly of claim 1 wherein the housing is adapted to mount to a vehicle chassis such that the longitudinal axis is mounted at offset angle relative to a surface normal.

14. A lighting assembly comprising:

a housing defining a cavity that is aligned along a longitudinal axis;

at least one light source supported by the housing and aligned with the longitudinal axis;

at least one lens supported by the housing to collimate light from the light source;

an image plate with a plurality of apertures formed through to pass a portion of the collimated light as light segments;

a first series of optics spaced apart from the image plate at a first focal distance to focus the light segments at a first distance from the housing; and a second series of optics spaced apart from the image plate at a second focal distance to focus the light segments at a second distance from the housing, wherein the second distance is greater than the first distance.

15. The lighting assembly of claim 14, wherein the first series of optics focus the light segments at the first distance from the housing at a first intensity level, wherein the second series of optics focus the light segments at the second distance from the housing at a second intensity level, and wherein both the first intensity level and the second intensity level are greater than a threshold intensity level.

16. The lighting assembly of claim 14, wherein the second series of optics are arranged in at least one of a radially symmetric pattern and a bilaterally symmetric pattern.

17. The lighting assembly of claim 14, wherein the second series of optics comprises a plurality of optics that are each formed with a length and a width that are each at least one millimeter, and an aspherical pillow shaped cross section.

18. A method for illumination, comprising:

activating a first light source in a light assembly to generate light through an axially aligned first collimator and corresponding axially aligned first apertures of an image plate, and then through a first series of optics arranged at a first focal distance from the image plate to project a first image segment at a first distance; and activating a second light source in the light assembly to generate light through an axially aligned second collimator and corresponding axially aligned second apertures of the image plate, and then through a second series of optics arranged at a second focal distance from the image plate to project a second image segment at a second distance, wherein the first image segment and the second image segment collectively provide an image.

19. The method of claim 18 further comprising activating the second light source, independently of activating the first light source, to provide a dynamic image.

20. A computer program module programmed to convey signals to perform the method of claim 18.

* * * * *